United States Patent [19]

Vik

[11] 4,064,669

[45] Dec. 27, 1977

[54] STATIONARY SUPPORTING STRUCTURE

[76] Inventor: Kjeld Vik, Christian Sindings vei 18, N-1410 Kolbotn, Norway

[21] Appl. No.: 648,132

[22] Filed: Jan. 12, 1976

Related U.S. Application Data

[63] Continuation of Ser. No. 519,848, Nov. 1, 1974, abandoned.

[30] Foreign Application Priority Data

May 16, 1973 Norway ..... 732045

[51] Int. Cl.[2] ..... E04C 3/30; E02D 27/42

[52] U.S. Cl. ..... 52/299; 52/423; 52/724; 52/725; 52/741

[58] Field of Search ..... 175/9; 61/86; 52/167, 52/741, 169.13, 272, 295, 296, 297, 299, 423, 724, 725

[56] References Cited

U.S. PATENT DOCUMENTS

| | | | |
|---|---|---|---|
| 679,306 | 7/1901 | Freund | 52/423 |
| 762,496 | 6/1904 | Smith | 52/423 |
| 824,501 | 6/1906 | Molloy | 52/648 |
| 1,211,164 | 1/1917 | Jones | 61/54 |
| 2,574,140 | 11/1951 | Boschen | 61/96 |
| 3,381,482 | 5/1968 | Manning | 61/86 |

FOREIGN PATENT DOCUMENTS

| | | | |
|---|---|---|---|
| 757,954 | 1/1934 | France | 52/297 |
| 541,199 | 3/1956 | Italy | 52/297 |

*Primary Examiner*—Price C. Faw, Jr.
*Assistant Examiner*—J. L. Ridgill
*Attorney, Agent, or Firm*—Emrich, Root, O'Keeffe & Lee

[57] ABSTRACT

A stationary supporting structure comprising one or more columns each assembled from a prefabricated concrete foundation element having a vertical steel tube linked to its upper surface to serve as a guide for annular prefabricated concrete elements which are successively threaded onto the tube. Initial skew due to an inclined ground at the erection site and tolerances in the length of any tie rods between the columns may be compensated for due to the fact that the prefabricated elements, although mating, may be displaced relatively to each other during erection of the structure, the mating surfaces being minor spherical surfaces, whereby the axis of each element can be adjusted relative to the axis of the next lower or upper element. After assembly of the prefabricated elements, the interior of the guide tube for the annular elements and the space between the tube and the walls of the central opening of the annular elements have been filled with concrete so as to connect the elements to a rigid coherent column.

13 Claims, 3 Drawing Figures

STATIONARY SUPPORTING STRUCTURE

This is a continuation, of application Ser. No. 519,848, filed Nov. 1, 1974 now abandoned.

BACKGROUND OF THE INVENTION

The present invention relates to a stationary supporting structure comprising a column consisting of prefabricated superjacent elements and a vertical central steel tube extending through throughgoing apertures in the elements, the adjacent elements having mating concave and convex, respectively, spherical bearing surfaces. The structure preferably comprises a plurality of interconnected columns of this type, but the principles according to the invention may also be used in the construction of a single column if desired. The structure is especially advantageous in the construction of a platform or the like resting on the sea bed, but positioned above the sea level, such as platforms for the production of oil from the sea bed. However, the supporting structure may also advantageously be used for other structures such as bridges or the like if there are difficulties connected with the erection of a suitable formwork for a concrete column.

Known platforms having a supporting structure resting on the sea bed, the platform itself being positioned substantially above the sea level (in the North Sea at least 20 m), are huge and expensive due to the difficulties connected with the production thereof, especially in relatively deep waters, such as 60 to 70 m or more. It is known to errect certain concrete structures at the coast and then float the structures to the required position, where they are lowered and placed on the sea bed. An example of such a structure is the oil storage tank installed at the Ekofisk field in the Norwegian sector of the North Sea. Hollow concrete columns which may be used e.g. to support platforms may be produced in a similar way as the Ekofisk tank, the columns being subsequently floated to the erection site and positioned on the sea bed. Since, in connection with such platforms the diameter of the columns may be in the order of 5 m, the columns are very large and heavy and consequently difficult to manoeuvre.

SUMMARY OF THE INVENTION

The object of the present invention is to arrive at a cheaper and simplier method for the production of a stationary supporting structure consisting of one or more columns and being especially adapted for platforms or the like which are to be founded on the sea bed. The invention also relates to the finished stationary supporting structure and prefabricated elements for use in carrying out the method.

The stationary supporting structure according to the invention is characterized in that the lower end of the central tube is linked to the upper surface of a prefabricated concrete foundation element, that concrete column elements stacked on the foundation element have throughgoing apertures having a diameter substantially larger than the outer diameter of the central tube, and that the space between the tube and the walls of the apertures in the column elements and also the interior of the tube are filled with concrete, whereby the column constitutes a rigid concrete structure in which the central steel tube is embedded in concrete and serves as a reinforcement against moment loads.

The method for the production of such stationary supporting structures is characterized in that for the construction of each column there is used a steel guide tube, the lower end of which is linked to the top of a concrete foundation element approximately in the middle of the bearing surface thereon, the guide tube being lowered and lengthened, if necessary, until the foundation element rests on the ground and the guide tube reaches the required level, that the tube is adjusted into an exactly vertical position, that prefabricated concrete column elements each having a throughgoing aperture of substantially larger diameter than the steel tube and at its end having concave and convex, respectively, minor spherical bearing surfaces are consecutively threaded onto the guide tube and adjusted to have their axis in a required direction, and that the space between the guide tube and the walls of the apertures in the column elements and also the interior of the guide tube are filled with concrete, so that each column comprised by the foundation element, the guide tube and the column elements is tied together into a rigid structure in which the guide tube is embedded in concrete and serves as a reinforcement against moment loads.

Further objects, features and advantages of the invention will be evident to those skilled in the art from a reading of the following detailed specification and claims, reference being had to the accompanying drawings which show an embodiment having three interconnected columns and constituting the supporting structure for a platform which is positioned above the sea level, but which is not illustrated in the drawings.

BRIEF DESCRIPTION OF THE DRAWINGS

FIG. 3 is a vertical section on a larger scale through the lower end of a column and illustrates the manner in which skews of the foundation elements due to inclinations of the sea bed may be compensated for.

DETAILED DESCRIPTION OF THE PREFERRED EMBODIMENT

Figure 1:
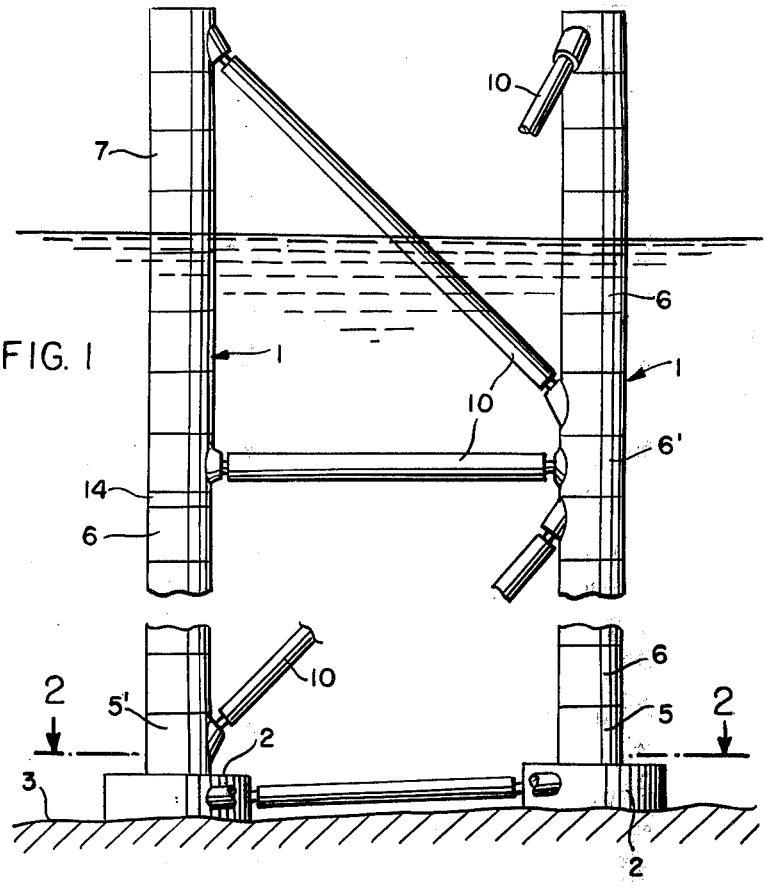
FIG. 1 is a diagrammatical side view illustrating two of the columns of the supporting structure.
Figure 2:
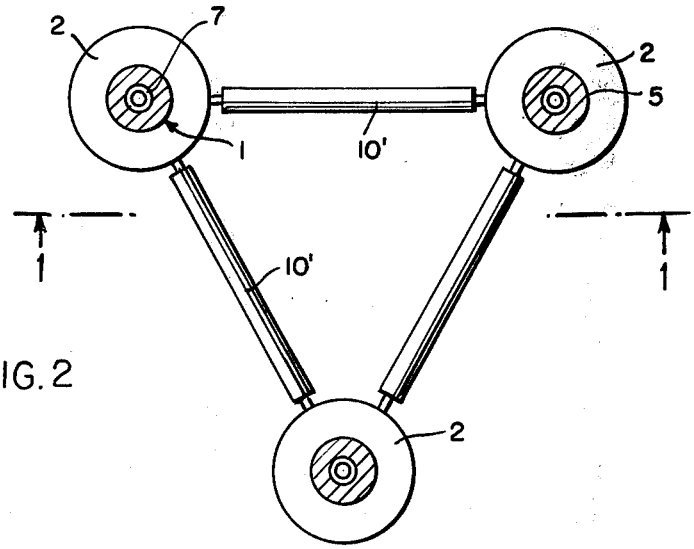
FIG. 2 is plan view in section through the supporting structure, showing that in the embodiment illustrated the three columns with their foundation elements are positioned at the corners of an equilateral triangle.

FIGS. 1 and 2 illustrate the general structure of a stationary supporting structure according to the invention resting on the sea bed and consisting of three columns 1. Each column comprises a foundation element 2 having a sufficiently large surface area for transferring the expected load to the ground, i.e. the sea bed 3. The bottom of each foundation element 2 may be shaped in a known manner in order to secure a reliable foundation and transfer of the load to the ground. If necessary, the foundation elements may e.g. be provided with a skirt penetrating into the ground and permitting injection of e.g. concrete between the bottom of the foundation element and the ground. The novelty of the foundation element according to the invention lies in the design of the upper side thereof. Thus, approximately in the middle of the upper side of the foundation element, there is provided a bed or socket 4 (see FIG. 3) of the shape of a minor sphere adapted to serve as a bearing surface for a mating minor spherical surface of a prefabricated column element 5 which together with further superjacent prefabricated column elements 6 form each of the three columns 1. The bearing surfaces of the foundation elements and of the column elements may be coated with an epoxy resin. Approximately centrally in the socket or bearing surface 4 the foundation element 2 is linked to a vertical guide and reinforcement tube 7 of steel. In the drawing this link or joint is illustrated as consisting of a number of ordinary reinforcing rods 8, which are embedded in the concrete of the foundation element 2 and extend centrally through a bottom plate 9 of the steel tube 7, said rods being secured to the steel tube 7, e.g. by welding to the inner walls thereof. This manner of providing a link or joint is conventional in concrete structures. The steel tube 7 extends over the entire required height of the column 1.

The three columns are interconnected by means of tie rods 10 which may be prefabricated and which are connected at one end to an element of one column and at the other hand to an element of another column. Also the foundation elements 2 of each column may be interconnected by means of prefabricated concrete connecting bars 10', which are linked to the foundation elements, thereby permitting all the foundation elements to come into flat engagement with the ground 3 although the ground may not be even.

Figure 3:
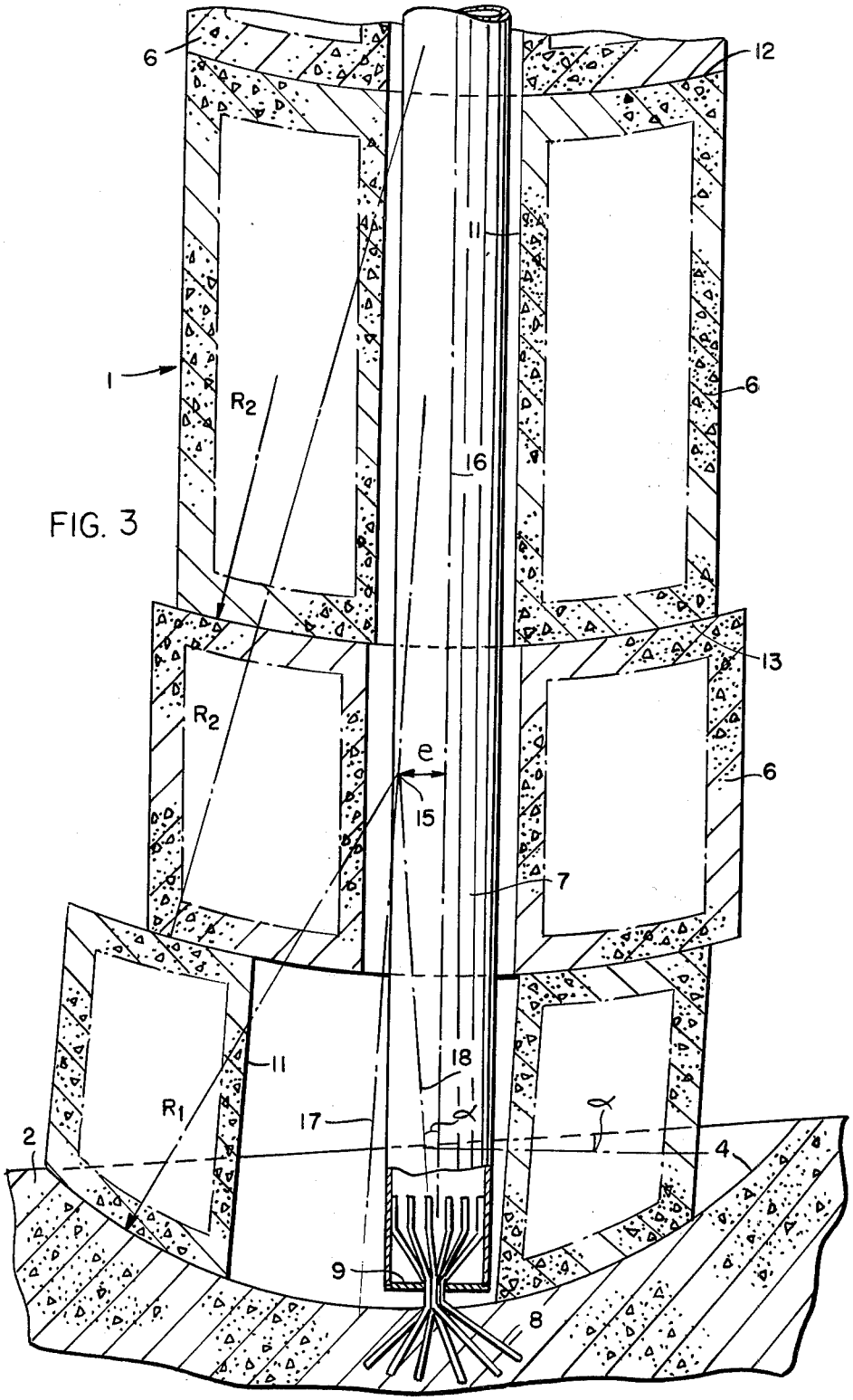

The prefabricated concrete column elements 5 and 6 which are referred to above and which are of annular shape, may conveniently be cylindrical both exteriorly and interiorly and have any suitable size compatible with the requirement for easy production and handling of the elements. As indicated in FIG. 3 the elements may be hollow, whereby the weight and buoyancy of the elements may be controlled. This means that the elements may be towed in a floating condition to the construction site and there be given any desired weight for controlled lowering by letting in water into the interior compartments or hollow spaces through suitable valves (not illustrated). This is of course true also for the foundation element 2. When the structure has been erected, the hollow spaces may, if required, be completely filled with water, sand, mortar or other material. The circular-cylindrical throughgoing aperture 11 in the column elements 5 and 6 may have a diameter which is merely slightly larger than the outer diameter of the steel tube 7, if the structure rests on a horizontal bed. Thus, if the steel tube has an outer diameter of 1 m, the aperture 11 may suitably have an inner diameter of 1,25 m. The end faces 12 and 13 (top and bottom, respectively) of the column element 6 between which the aperture 11 extends, are spherical in order to mate with the corresponding spherical bearing surfaces at the top of the next underlying column element and the bottom of the next overlying column element. Preferably, the majority of the column elements 5 and 6 have the same height and diameter as well as the same radius of curvature of the spherical bearing surfaces. However, it will be understood that there is nothing preventing the elements from being different from each other, provided that the adjacent bearing surfaces have the same radius of curvature. Further, as will be discussed later, the lower elements of each column preferably have a reduced height and a larger diameter of the aperture 11. Special elements may also, as indicated at 5' and 6' in FIG. 1, be provided with joints or links for the tie rods 10. Even these column elements preferably have a reduced height. Finally, compensating elements 14 of any desired height may be used for equalizing differences in the level of the ground 3.

A further important feature of the structure according to the invention is that it may also be used when the bed under each foundation element is slightly inclined. This is illustrated in FIG. 3 in which the foundation element 2 is shown at an angle $\alpha$ with the horizontal plane. This angle entails that the centre of curvature 15 for the socket 4 will be offset from the central axis 16 of the vertical steel tube 7. In addition to its dependency on the angle $\alpha$, the offset or eccentricity $e$ also depends on the radius of curvature of the socket 4. In order that the eccentricity shall not be excessive it may be advantageous to make the socket 4 and accordingly also the bottom face of the lowermost column element 5 have a somewhat smaller radius of curvature $R_1$ than the radius of curvature $R_2$ chosen for the remaining column elements 6. If all the column elements 5, 6 have an inner diameter of the aperture 11 permitting the offset or eccentricity $e$, this eccentricity may be maintained all the way along the column 1, that is all the column elements may be aligned and have a central axis which is offset relative to the central axis 16. However, as shown in FIG. 3, it is also possible to compensate for the eccentricity $e$ by means of the lowermost column element 5 (or, if necessary, a few of the following column elements). To this end the aperture 11 of the column element 5 has a relatively large diameter, so that the central axis 17 of the element may be inclined oppositely to the inclination of the axis 18 of the foundation element. In order that the lowermost column element 5 shall provide a sufficient support of the superjacent column elements 6, even when inclined as indicated above, it may have a larger outer diameter as indicated in FIG. 3. Between the lowermost column element 5 and the ordinary column elements 6 there may be provided a transitional element **6*a* having somewhat larger outer and inner diameters than the column elements 6. By means of an element 5 as illustrated and a transitional element 6*a* an initial skew of the foundation element 2** in the order of several degrees may be compensated for.

The column structure according to the invention may be mounted as follows:

First, the foundation elements are connected in a desired configuration in floating condition by means of the connecting bars 10'. The lower portion of the steel tube 7 has already been secured to the foundation elements 2. This part of the mounting process may be effected in protected waters e.g. near the shore, and the resulting skeleton for the supporting structure may subsequently be floated to the erection site. In order to provide a rigid structure suitable for floating a mounting rig with a provisional working platform may be mounted on the foundation elements, the steel guide tubes 7 being releasably secured to the mounting rig. If the provisional working platform has a hollow box structure, the rigid structure consisting of the foundation elements 2, the connection bars 10', the steel tubes 7 and the mounting rig with its working platform may be floated to the erection site in a stable horizontal floating position.

At the erection site the foundation elements 2 may be lowered onto the sea bed with the tubes 7 in a general vertical position by known means, including a control of the buoyancy of the foundation elements 2 and of the provisional working platform. During lowering of the foundation elements 2 the steel tubes 7 may be lengthened by welding additional extension tubes to the upper end of each tube 7 as required. When the foundation elements have been placed on the sea bed, the steel tubes 7 are adjusted to exactly parallel vertical positions. The concrete column elements are now threaded onto the steel tube, the tube serving as a guide for the elements. In order that the column elements shall take the position required for the spherical bearing surfaces to be in full contact with each other and the subsequent elements to be correctly aligned relative to the steel tube 7, the column elements should be positive guided on the steel tube 7. The required guidance may be obtained by adjustable means (not illustrated) at the upper and the lower end of each column element. These adjustable means may, if desired, cooperate with means on the steel tube 7, e.g. longitudinal grooves therein, in order to ensure that the elements cannot rotate about the steel tube 7.

Two column elements 5' and 6', preferably elements having a reduced height and a somewhat larger diameter of the aperture 11 such as the element *6a* in FIG. 3, may be connected by a tie rod 10 and the two column elements threaded onto two guide tubes 7 at the same time. The larger diameter of the aperture 11 in the elements 5' and 6' allows for a lateral displacement of one or both column elements to compensate for tolerances, whereby the use of a prefabricated tie rod of fixed length becomes possible. The preferred reduced height of the elements 5' and 6' ensures that the inclined axis of the displaced element will not unduly offset the centre of curvature from the central axis of the guide tube 7. If desired, this offset may be compensated for by the use of a column element *6a* inclined in the opposite direction, thereby bringing its centre of curvature back the axis of the guide tube 7.

Since the frictional forces between the column elements are rather large due to the weight of the elements when filled with e.g. water, the tie rods 10 connect the three columns to a relatively rigid structure. For further bonding of the various elements of the structure, the interior of the steel tube 7 and the space between the steel tube 7 and the walls of the aperture 11 are finally filled with concrete. When this concrete has set, a coherent structure is obtained which will withstand the loads to which it is subjected during use, the steel tube 7 serving as a reinforcement against the moment loads.

For a controlled lowering of the various elements cranes or special rigs may be used. The cranes may be floating cranes. Alternatively, cranes or other hoisting gear may be mounted on the preliminary mounting platform. The correct position of the elements may be controlled by divers.

It is believed to be readily apparent that the principles on which the present invention is based, may be used in embodiments different from the platform described above. Those skilled in the art may easily conceive modifications of the embodiment disclosed and indicate other uses of the invention.

What I claim is:

1. Stationary supporting structure comprising at least one column defined by a plurality of annular prefabricated superjacent concrete column elements and vertically central steel tube, said tube having a diameter substantially smaller than the inner diameter of the annular prefabricated column elements to provide a partial linear contact between the tube and the walls of the central aperture of said concrete column elements when said column elements are mounted thereon, said walls and the tube being otherwise spaced from each other, a prefabricated concrete foundation element, said tube being linked to the upper surface of the foundation element, the upper surface of said foundation element and the adjacent ends of each column element having mating minor spherical bearing surfaces allowing disalignment of the axis of said column during erection, said column elements and the tube being locked together to provide a rigid structure by concrete filling the space between the tube and the walls of the central apertures of said column elements.

2. Structure as claimed in claim 1, including a plurality of said columns interconnected by means of prefabricated fixed length concrete tie rods connected at each end to a column element of a column.

3. Structure as claimed in claim 1, including a plurality of columns the foundation elements of which are interconnected by prefabricated concrete connecting bars which are linked to said foundation elements.

4. In a method for the construction of a stationary supporting structure having at least one column, comprising the following steps:

a. lowering to the ground a concrete foundation element having a top bearing surface in the form of a minor spherical surface and a guide tube linked to the foundation element approximately in the middle of said bearing surface, b. adjusting the guide tubes to a vertical position, c. consecutively threading prefabricated annular concrete elements onto the guide tube and lowering said elements to superjacent positions with the lowermost column element resting on the bearing surface of the foundation element, the adjacent ends of each column element having mating minor spherical bearing surfaces, and the central apertures of the annular element having a diameter sufficiently large to allow the column elements to be positioned with their respective axes at an angle with the axis of the guide tube and to provide a space between the guide tube and the walls of the aperture of the column elements, d. adjusting the column elements as they are lowered so as to position them with their respective axes at a desired angle to the axis of the respective subjacent element, said angle including the value of zero, e. filling the space between the guide tube and the walls of the concrete apertures of the column elements as well as the interior of the tube with concrete, and f. allowing said concrete to set for tieing together the foundation element, the guide tube and the column elements into a rigid structure.

5. A method as claimed in claim 4, wherein the step of adjusting the column elements comprises positioning the column elements relative to the guide tube so that the centers of the spherical bearing surfaces of the majority of the superjacent column elements lie directly above each other and close to the axis of the guide tube.

6. A method as claimed in claim 4, for the construction of a structure having a plurality of said columns comprising the further step of connecting prefabricated fixed length tie rods at one end to a column element of one column and at the other end to a column element of another column, tolerances being compensated for by a lateral displacement of one or both of the column elements connected to the ends of each tie rod, said connecting step being performed prior to the filling of the space between the guide tube and the walls of the apertures in the column elements.

7. A method as claimed in claim 4, for the construction of a structure having a plurality of said columns, comprising the further step of interconnecting the foundation elements of several columns by means of connecting bars, said connecting bars determining the configuration of the assembled foundation elements, said interconnecting step being performed prior to the lowering of the foundation elements.

8. A column element for use in the construction of a stationary supporting structure, said column element being of concrete and having a throughgoing aperture, end faces of said column element between which the aperture extends having minor spherical surfaces, one face being concave and the other convex, with said minor spherical surfaces adapted to serve as a bearing surface for an adjacent positioned column element.

9. An element as claimed in claim 8 having fastening means for a tie rod.

10. An element as claimed in claim 8, wherein said element is hollow.

11. An element as claimed in claim 8, wherein the centers of curvature of the two spherical end faces are situated in the longitudinal axis of said element.

12. An element as claimed in claim 8, wherein the aperture extends centrally through said element.

13. A prefabricated structural element for use in the production of a stationary supporting structure, comprising a concrete foundation element having a lower surface for contact with the ground and an upper minor spherical bearing surface, and a steel tube the lower end of which is linked to said foundation element in a position approximately centrally of the bearing surface.

* * * * *